US007345564B2

(12) United States Patent
Chang

(10) Patent No.: US 7,345,564 B2
(45) Date of Patent: Mar. 18, 2008

(54) TRANSFORMER STRUCTURE

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/534,079

(22) Filed: Sep. 21, 2006

(65) Prior Publication Data

US 2007/0159288 A1 Jul. 12, 2007

(30) Foreign Application Priority Data

Jan. 11, 2006 (TW) ..... 95101078 A

(51) Int. Cl.
*H01F 5/00* (2006.01)

(52) U.S. Cl. ..... 336/200

(58) Field of Classification Search ..... 336/65, 336/83, 90, 92, 196, 198, 200, 183, 223
See application file for complete search history.

(56) References Cited

U.S. PATENT DOCUMENTS

2003/0038696 A1* 2/2003 Chui et al. ..... 336/198
2005/0073385 A1* 4/2005 Wu et al. ..... 336/208
2007/0052513 A1* 3/2007 Chang ..... 336/212

* cited by examiner

*Primary Examiner*—Tuyen T. Nguyen
(74) *Attorney, Agent, or Firm*—Kirton & McConkie; Evan R. Witt

(57) ABSTRACT

A transformer structure is disclosed. The transformer structure comprises a main body, a primary winding coil, a secondary winding coil, a first winding portion, a second winding portion and a magnetic core assembly. The main body has a first side, a second side, at least a through hole, a first receiving chamber communicating with the first side, a second receiving chamber communicating with the second side, and a separating wall disposed between the first receiving chamber and the second receiving chamber. The first winding portion for winding the primary winding coil thereon is disposed in the first receiving chamber and has a first channel communicating with the through hole. The second winding portion for winding the secondary winding coil thereon is disposed in the second receiving chamber and has a second channel communicating with the through hole. The magnetic core assembly is partially disposed in the through hole of the main body, the first channel of the first winding portion and the second channel of the second winding portion.

9 Claims, 15 Drawing Sheets

6

TRANSFORMER STRUCTURE

FIELD OF THE INVENTION

The present invention relates to a transformer structure, and more particularity to a transformer structure able to increase the leakage inductance.

BACKGROUND OF THE INVENTION

A transformer has become an essential electronic component for various kinds of electric appliance. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are wounded around the bobbin 12. A tape 15 is provided for isolation and insulation. The magnetic core assembly 11 is generally shaped as an EE-type core, an EI-type core or an ER-type core. The middle portions 111 of the core 11 are embedded into the cylinder tube 121 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are superimposed with each other and wounded around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the power supply system of the electric products for the new generation, for example LCD televisions, the transformer with leakage inductance prevails. The current generated from the power supply system will pass through a LC resonant circuit composed of an inductor L and a capacitor C. The inductor L is provided from the primary winding coil of the transformer. Meanwhile, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch and minimize the noise.

In order to increase the leakage inductance of the transformer, the primary winding coil should be separated from the secondary winding coil by a certain distance to reduce the coupling coefficient of the transformer. Referring to FIG. 2, a schematic exploded view of a transformer with leakage inductance according to prior art is illustrated. The transformer 2 principally comprises a bobbin 21, a primary winding coil 22 and a secondary winding coil 23. The bobbin 21 comprises a first side plate 211, a second side plate 212 and a winding member 213. A tape 24 is wound around the middle portion of the winding member 213 and has a width d. The winding member 213 is divided into a first winding portion 2131 and a second winding portion

2132, which are located at bilateral sides of the tape 24. The primary winding coil 22 and the secondary winding coil 23 are wound around the first winding portion 2131 and the second winding portion 2132, respectively. The first winding portion 2131 is separated from the first side plate 211 by wrapping a first side tape 25 on the winding member 213 between the first winding portion 2131 and the first side plate 211. Likewise, the second winding portion 2132 is separated from the second side plate 212 by wrapping a second side tape 26 on the winding member 213 between the second winding portion 2132 and the second side plate 212. For safety regulations, the tape 24 is used for isolation between the primary winding coil 22 and the secondary winding coil 23. Via the first side tape 25 and the second side tape 26, the primary winding coil 22 and the secondary winding coil 23 are electrically isolated from the conductors outside the transformer 2. As the width d of the tape 24 between the primary winding coil 22 and the secondary winding coil 23 is increased, the coupling coefficient is reduced and the leakage inductance of the transformer is increased. Under this circumstance, the resonant circuit of the power supply system will be conveniently controlled.

Although the transformer structure of FIG. 2 is advantageous for increasing the leakage inductance, some drawbacks still exist. As previously described, the magnitude of the leakage inductance is dependent on the width d of the tape 24 between the primary winding coil 22 and the secondary winding coil 23. Since the tape 24 is made of flexible material and fails to be firmly fixed, the structure of the transformer is readily distorted due to a long-term using period or serious vibration. Under this circumstance, the magnitude of the leakage inductance is reduced or unstable, and the resonant circuit of the power supply system will be adversely affected. Since these tapes are sticky and narrow in width, the procedures of wrapping the tape 24, the first side tape 25 and the second side tape 26 are labor-intensive and complicated. In addition, if the wrapping result is unsatisfied, the electrical performance of the transformer is impaired.

Since the tape 24, the first side tape 25 and the second side tape 26 are wrapped on the winding member 213 of the bobbin 21, the remaining area or volume for winding the primary winding coil 22 and the secondary winding coil 23 around the winding member 213 is limited and thus the heat-dissipating effect is usually insufficient. Furthermore, after the procedures of winding the coils and wrapping the tapes, a layer of insulating tape is additionally wrapped around the primary winding coil 22 and the secondary winding coil 23. The insulating tape also impairs heat dissipation of the transformer during operation. Moreover, since the melting point of the tape 24 is relatively lower, the operating temperature of the transformer is restricted by the melting point of the tape 24.

With increasing development of electronic technologies, the electric conversion efficiency of a power converter to be used in an electronic product is gradually demanding. For example, in a case that a voltage is intended to be converted from a low voltage (e.g. 400V) to a high voltage (e.g. 2,000V), for meeting the requirement of safety regulations, the distance between the primary winding coil and the secondary winding coil should be increased to avoid conduction between the primary winding coil and the secondary winding coil. Unfortunately, since the width d of the tape 24 is insufficient and the converted voltage is too high, the conduction between the primary winding coil and the secondary winding coil is possible.

In views of the above-described disadvantages, the applicant keeps on carving unflaggingly to develop a structure of a transformer according to the present invention through wholehearted experience and research.

SUMMARY OF THE INVENTION

It is an object of the present invention to provide a transformer structure by disposing the primary winding coil and the secondary winding coil in different receiving chambers to separate the primary winding coil and the secondary winding. Since the openings of the receiving chambers for respectively receiving the primary winding coil and the secondary winding coil are disposed on different sides of the main body, the leakage inductance can be increased and effectively controlled to solve the problems of the prior art.

In accordance with an aspect of the present invention, a transformer structure is provided. The transformer structure comprises a main body, a primary winding coil, a secondary winding coil, a first winding portion, a second winding portion and a magnetic core assembly. The main body has a first side, a second side, at least a through hole, a first receiving chamber communicating with the first side, a second receiving chamber communicating with the second side, and a separating wall disposed between the first receiving chamber and the second receiving chamber. The first winding portion for winding the primary winding coil thereon is disposed in the first receiving chamber and has a first channel communicating with the through hole. The second winding portion for winding the secondary winding coil thereon is disposed in the second receiving chamber and has a second channel communicating with the through hole. The magnetic core assembly is partially disposed in the through hole of the main body, the first channel of the first winding portion and the second channel of the second winding portion.

In an embodiment, the first side and the second side are on opposite sides of the main body.

In an embodiment, both ends of the main body respectively comprise an indentation for receiving part of the magnetic core assembly when assembling the main body and the magnetic core assembly.

In an embodiment, an opening of the through hole leads to the indentation for receiving the magnetic core assembly.

In an embodiment, the magnetic core assembly is a UI-core assembly, a UU-core assembly or an EE-core assembly and comprises a first magnetic core and a second magnetic core.

For example, the magnetic core assembly is the UI-core assembly, the first magnetic core is a U-shaped magnetic core and has a plurality of extending portions, the second magnetic core is an I-shaped magnetic core and is received in the through hole and the indentation, the first magnetic core is disposed on the main body, and the plurality of extending portions are received in the indentation for contacting with the second magnetic core.

For example, the magnetic core assembly is the UU-core assembly, each of the first magnetic core and the second magnetic core is a U-shaped magnetic core and has a plurality of extending portions, one of the extending portions of each of the first magnetic core and the second magnetic core is disposed in the through hole and the indentation to make the extending portion of the first magnetic core disposed in the through hole contact with the extending portion of the second magnetic core disposed in the through hole.

For example, the magnetic core assembly is the EE-core assembly, each of the first magnetic core portion and the second magnetic core is an E-shaped magnetic core and has a plurality of extending portions, the extending portions of each of the first magnetic core and the second magnetic core are disposed in corresponding the through holes and the indentation to make the extending portions of the first magnetic core contact with the extending portions of the second magnetic core.

In an embodiment, the main body further comprises an extending board to form a receiving groove for receiving the magnetic core assembly.

In accordance with another aspect of the present invention, a transformer structure is provided. The transformer structure comprises a main body, a primary winding coil, a plurality of secondary winding coils, a first winding portion, a second winding portion, a third winding portion and a magnetic core assembly. The main body has a first side, a second side, a third side, at least a through hole, a first receiving chamber communicating with the first side, a second receiving chamber communicating with the second side, a third receiving chamber communicating with the second side or the third side, and separating walls respectively disposed between the first receiving chamber and the second receiving chamber, and between the first receiving chamber and the third receiving chamber. The first winding portion for winding the primary winding coil thereon is disposed in the first receiving chamber and has a first channel communicating with corresponding the through hole. The second winding portion for winding one of the secondary winding coils thereon is disposed in the second receiving chamber and has a second channel communicating with corresponding the through hole. The third winding portion for winding one of the secondary winding coils is disposed in the third receiving chamber and has a third channel communicating with corresponding the through hole. The magnetic core assembly is partially disposed in the through hole of the main body, the first channel of the first winding portion, the second channel of the second winding portion and the third channel of the third winding portion.

In accordance with a further aspect of the present invention, a transformer structure is provided. The transformer structure comprises a first winding module having a first through hole, a second winding module having a second through hole, and a magnetic core assembly having a first magnetic core and a second magnetic core. Each of the first magnetic core and the second magnetic core has a plurality of extending portions received in the first through hole of the first winding module and the second through hole of the second winding module to assemble the first winding module and the second winding module and make the extending portions of the first magnetic core disposed in the through holes contact with the extending portions of the second magnetic core disposed in the through holes. Each of the first winding module and the second winding module comprises a main body, a primary winding coil, a secondary winding coil, a first winding portion, a second winding portion and a magnetic core assembly. The main body has a first side, a second side, the through hole, a first receiving chamber communicating with the first side, a second receiving chamber communicating with the second side, and a separating wall disposed between the first receiving chamber and the second receiving chamber. The first winding portion for winding the primary winding coil thereon is disposed in the first receiving chamber and has a first channel communicating with the through hole. The second winding portion for winding the secondary winding coil thereon is disposed in the second receiving chamber and has a second channel communicating with the through hole.

In an embodiment, the main body further comprises a third receiving chamber communicating with the second side, a further secondary winding coil, and a further separating wall disposed between the third receiving chamber and the first receiving chamber.

In an embodiment, each of the first winding module and the second winding module comprises a third winding portion for winding the further secondary winding coil, and the third winding portion is disposed in the third receiving chamber and has a third channel communicating with the through hole.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 3(*b*) is a cross-sectional view of FIG. 3(*a*) along A-A' line;

FIG. 3(*c*) is a schematic view showing the assembled structure of the transformer in FIG. 3(*a*);

FIG. 4(*b*) is a cross-sectional view of FIG. 4(*a*) along B-B' line;

FIG. 4(*c*) is schematic view showing the assembled structure of the transformer in FIG. 4(*a*);

FIG. 4(*d*) is an exploded view showing the transformer structure according to a derivative embodiment from FIG. 4(*a*);

FIG. 5(*b*) is a schematic view showing the assembled structure of the transformer in FIG. 5(*a*);

FIG. 5(*c*) is an exploded view showing the transformer structure according to a derivative embodiment from FIG. 5(*a*);

FIG. 5(*d*) is a schematic view showing the assembled structure of the transformer in FIG. 5(*c*);

FIG. 6(*b*) is a cross-sectional view of FIG. 6(*a*) along C-C' line;

FIG. 6(*c*) is a schematic view showing the assembled structure of the transformer in FIG. 6(*a*);

FIG. 7(*b*) is a cross-sectional view of FIG. 7(*a*) along D-D' line; and FIG. 7(*c*) is a schematic view showing the assembled structure of the transformer in FIG. 7(*a*).

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
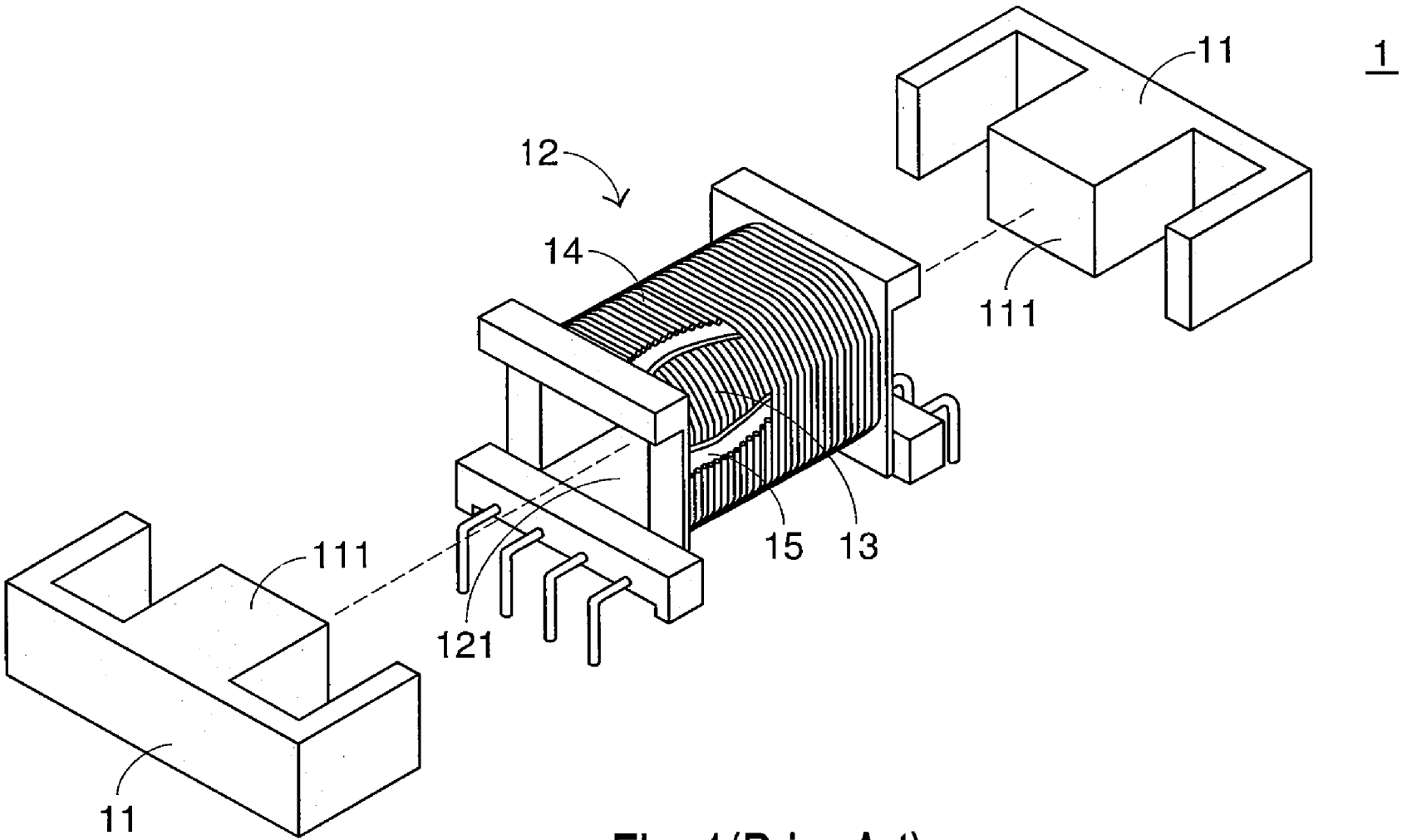
Fig. 1(Prior Art)
FIG. 1 is a schematic exploded view of a conventional transformer.
Figure 2:
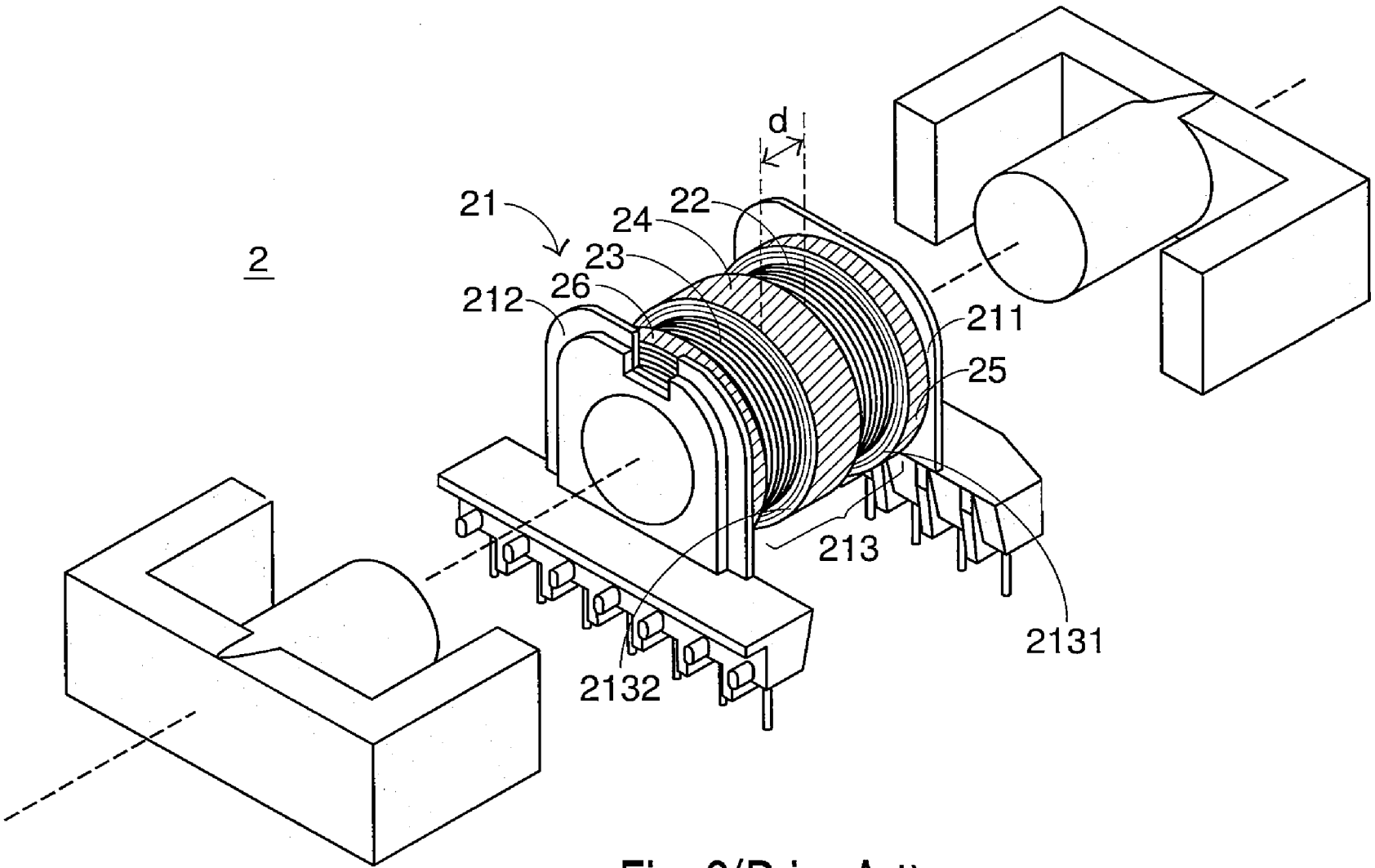
Fig. 2(Prior Art)
FIG. 2 is a schematic exploded view of another conventional transformer.
Figure 3A:
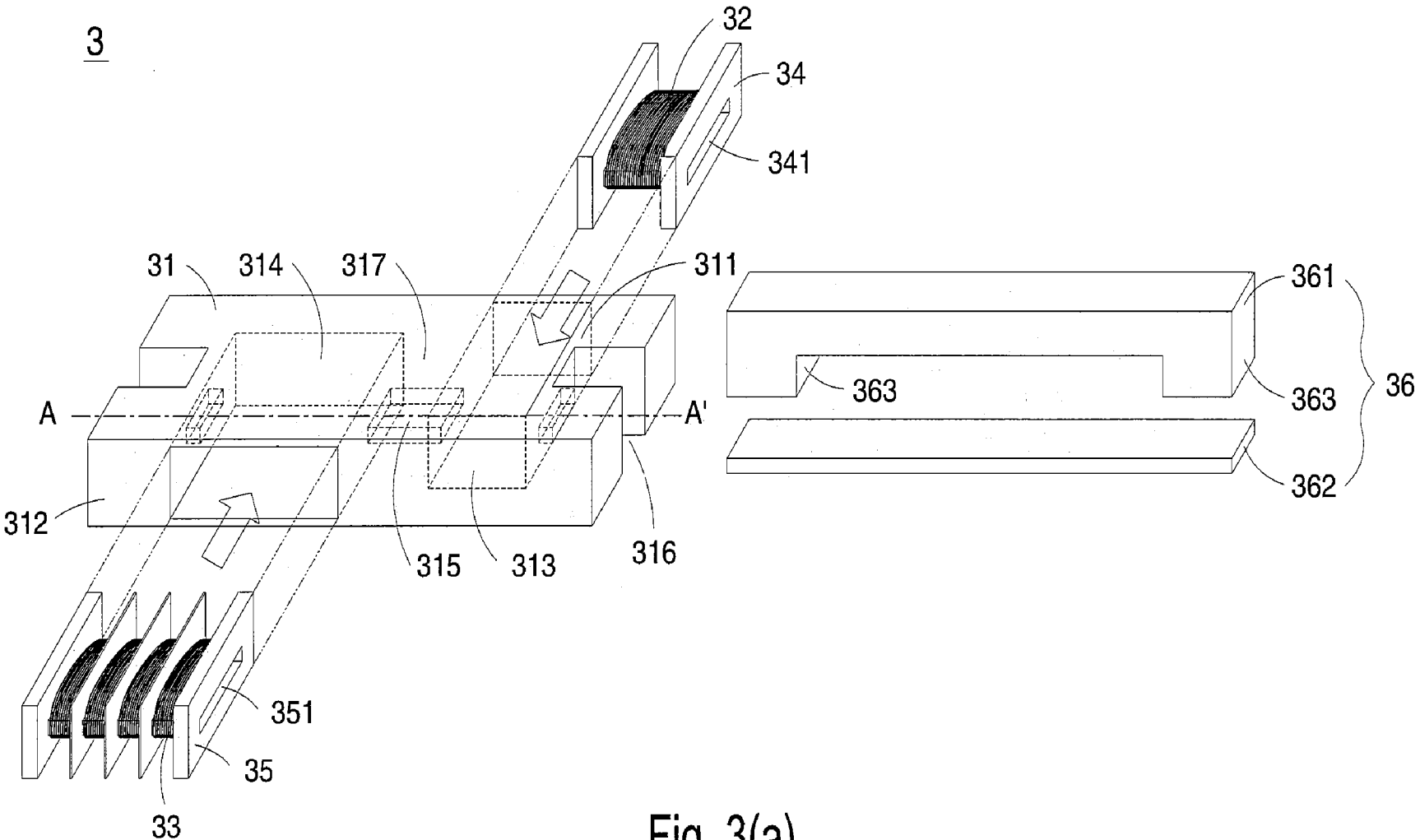
FIG. 3(*a*) is an exploded view showing the transformer structure according to the first preferred embodiment of the present invention.
Figure 3B:
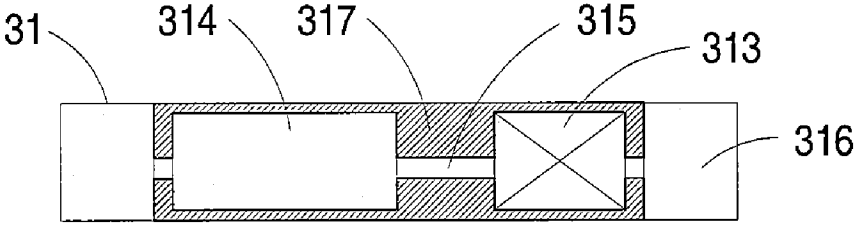
Figure 3C:
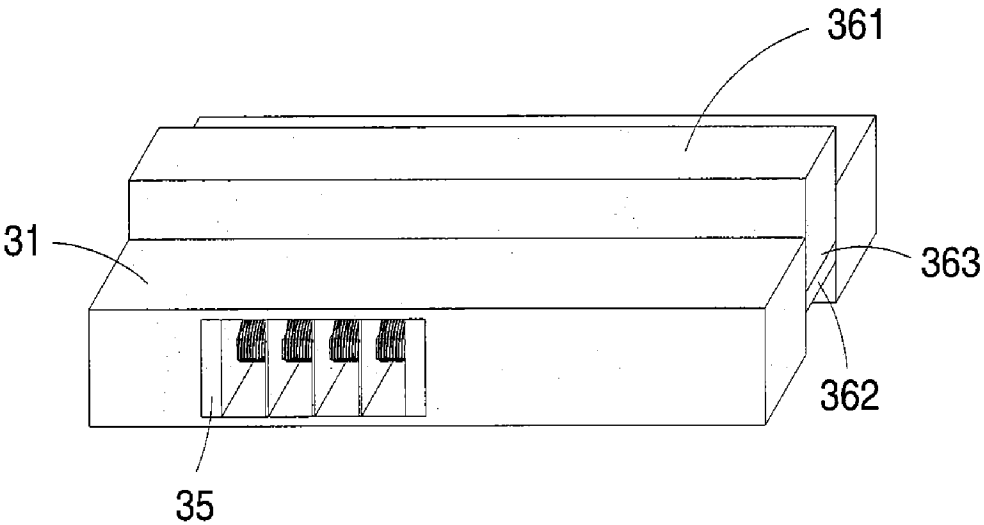
Figure 4A:
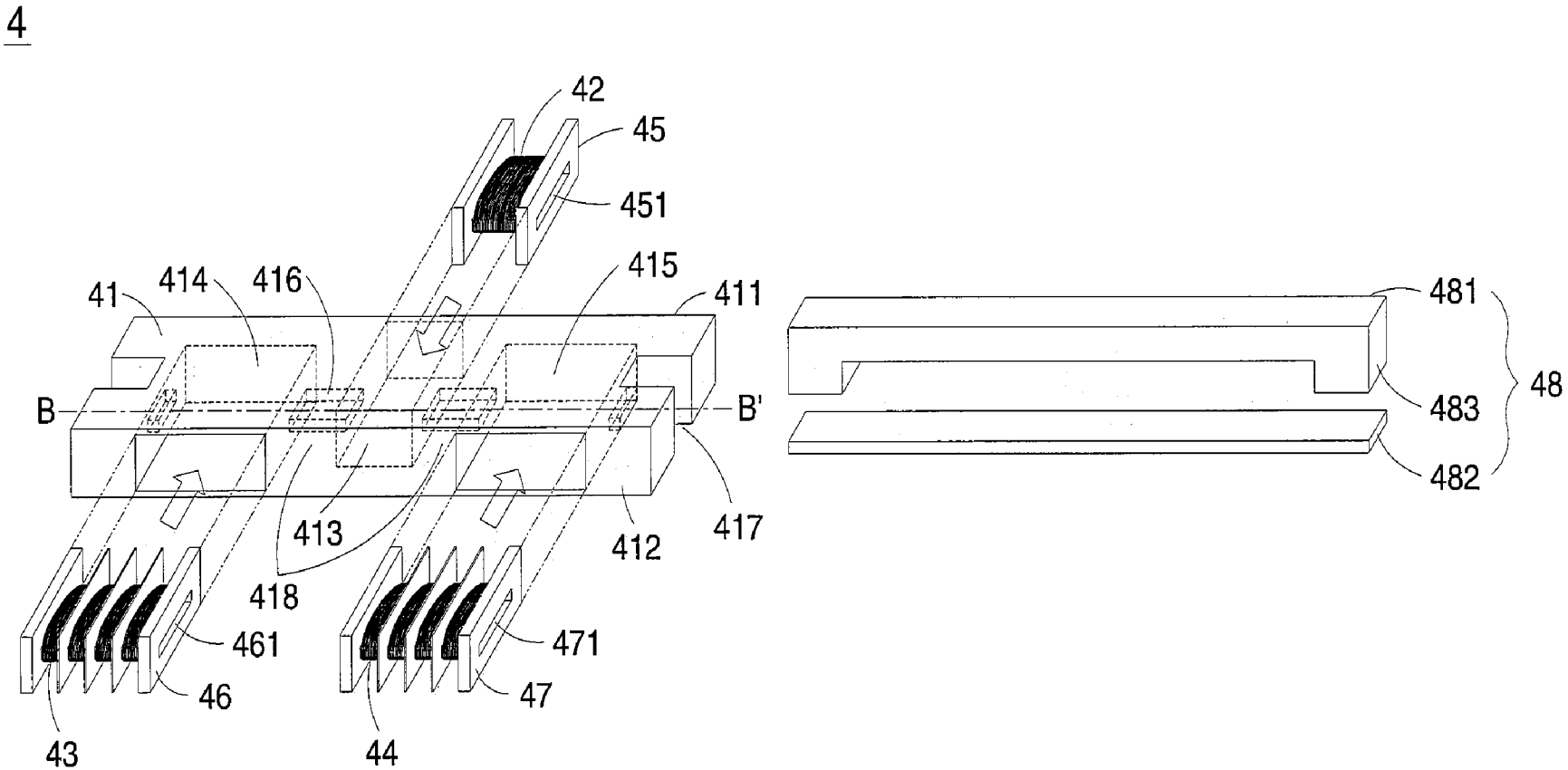
FIG. 4(*a*) is an exploded view showing the transformer structure according to the second preferred embodiment of the present invention.
Figure 4B:
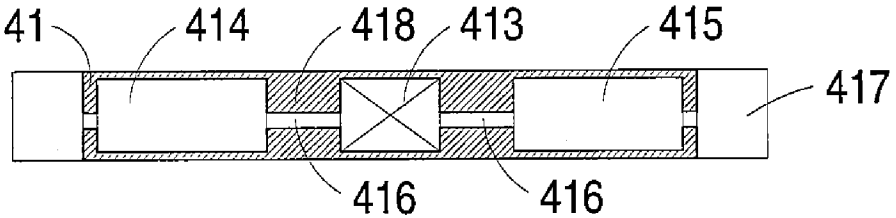
Figure 4C:
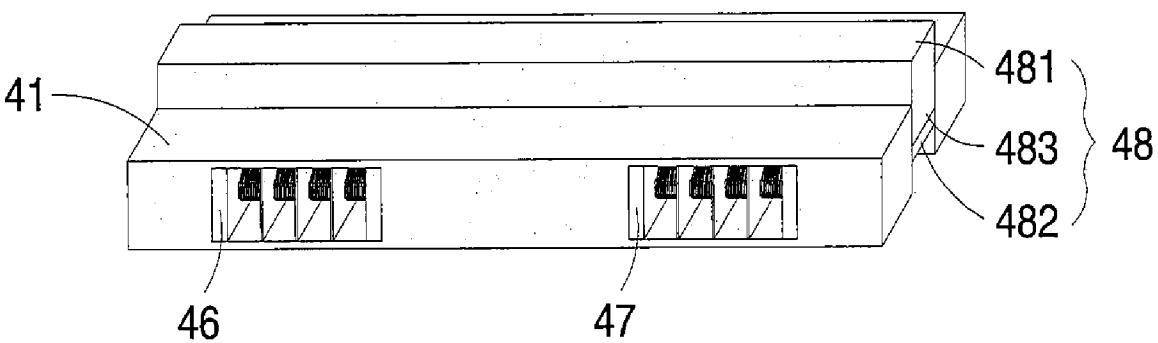
Figure 4D:
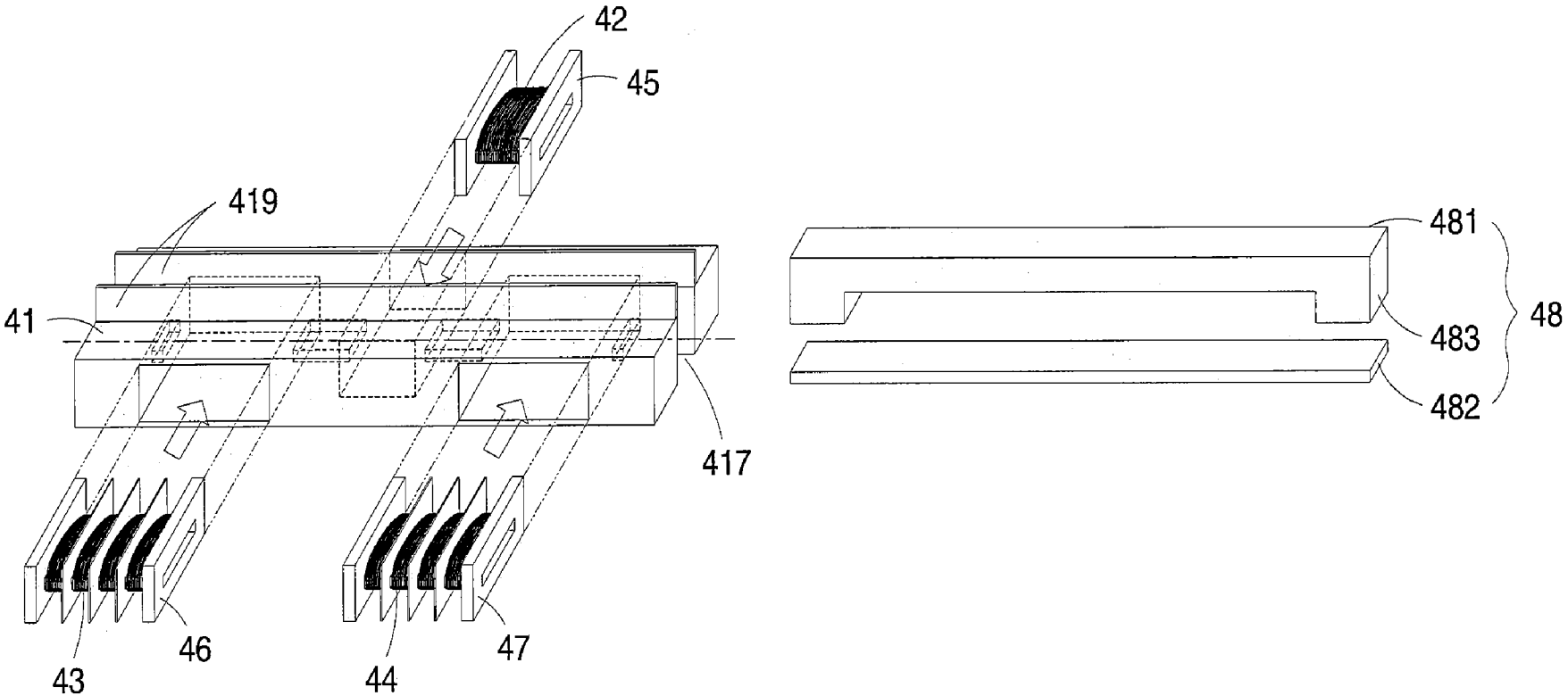
Figure 5A:
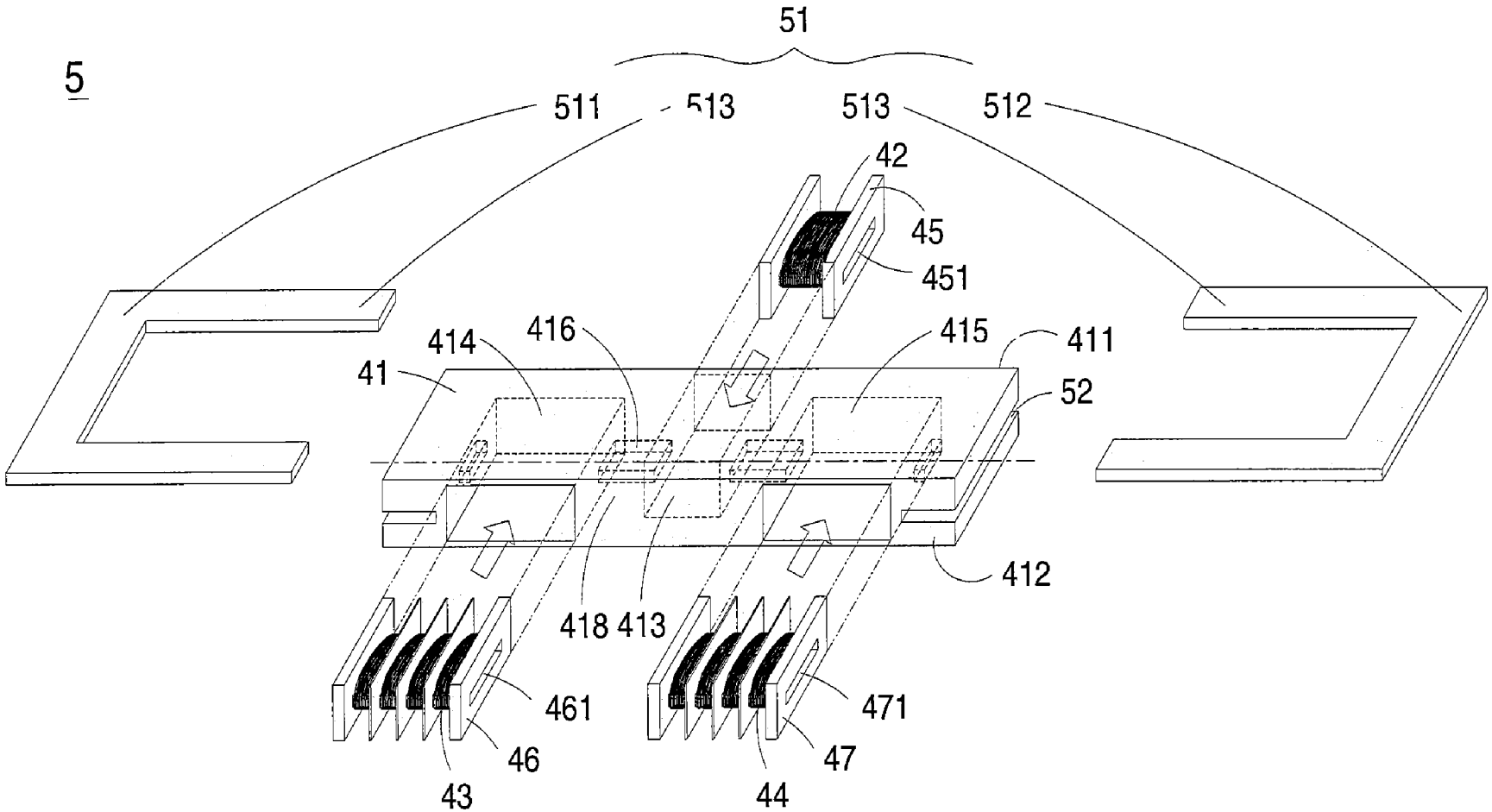
FIG. 5(*a*) is an exploded view showing the transformer structure according to the third preferred embodiment of the present invention.
Figure 5B:
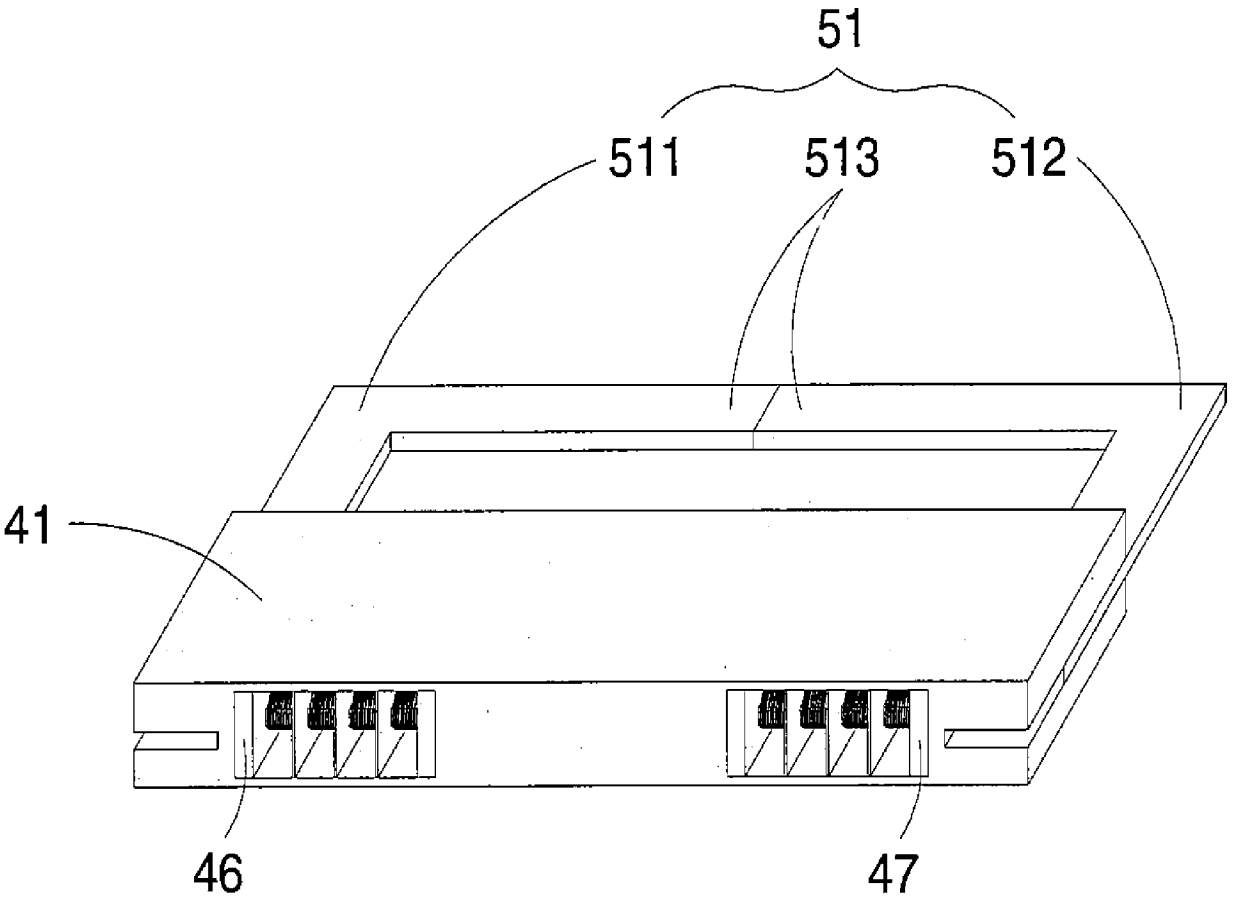
Figure 5C:
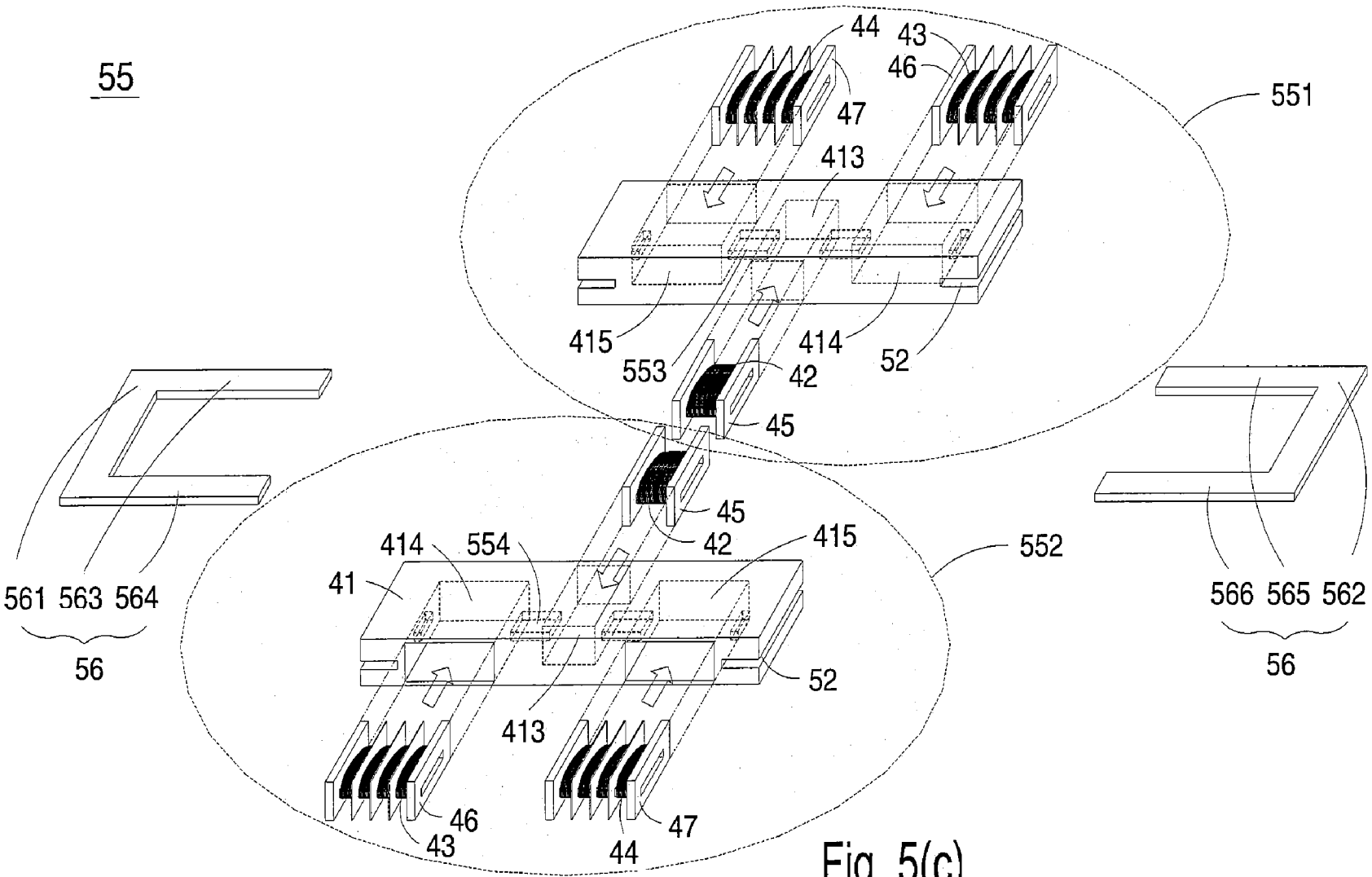
Figure 5D:
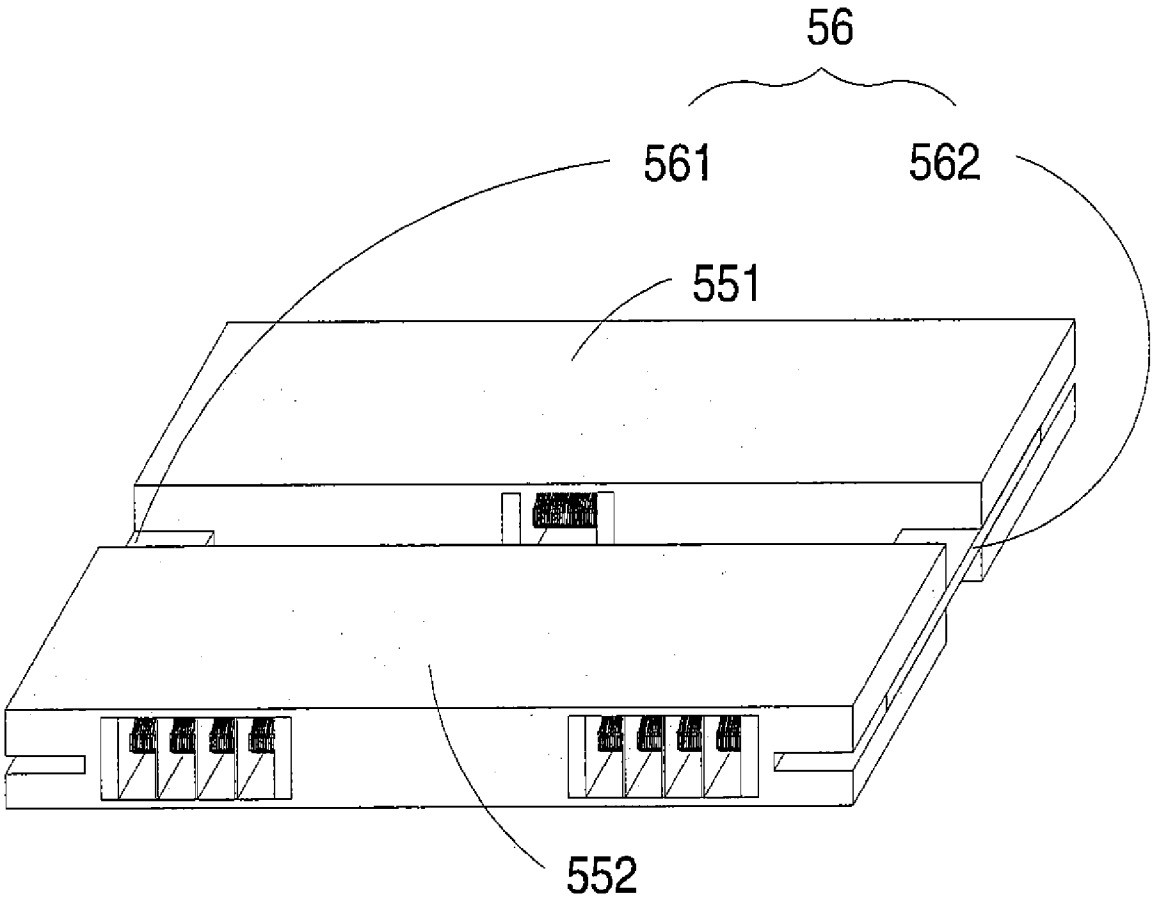

Please refer to FIG. 3(*a*), which is an exploded view showing the transformer structure according to the first preferred embodiment of the present invention. As shown in FIG. 3(*a*), the transformer 3 comprises a main body 31, a primary winding coil 32, a secondary winding coil 33, a first winding portion 34, a second winding portion 35 and a magnetic core assembly 36. The main body 31 has a first side 311, a second side 312, a first receiving chamber 313, a second receiving chamber 314, a through hole 315 and an indentation 316. The first receiving chamber 313 is disposed in the main body 31 and has an opening on the first side 311, so it communicates with the first side 311, and the second receiving chamber 314 is disposed in the main body 31 and has an opening on the second side 312, so it communicates with the second side 312.

The first winding portion 34 is mainly used for winding the primary winding coil 32 thereon and comprises a first channel 341. The first winding portion 34 is disposed in the first receiving chamber 313 communicating with the first side 311 of the main body 31. The second winding portion 35 is mainly used for winding the secondary winding coil 33 thereon and comprises a second channel 351. The second winding portion 35 is disposed in the second receiving chamber 314 communicating with the second side 312 of the main body 31. The first receiving chamber 313 and the second receiving chamber 314 are separated by a separating wall 317, and the first side 311 and the second side 312 are on the opposite sides of the main body 31.

Since the first receiving chamber 313 and the second receiving chamber 314 have the separating wall 317 disposed therebetween and the openings thereof are disposed on the opposite sides of the main body 31, the creepage distance between the first winding portion 34 and the second winding portion 35 is increased by the separation of the main body 31, so as to improve the safety of the electric appliance and increase the leakage inductance when the first winding portion 34 and the second winding portion 35 are respectively disposed in the first receiving chamber 313 and the second receiving chamber 314.

In this embodiment, the magnetic core assembly 36 can be a UI-core assembly and comprises a first magnetic core 361 and a second magnetic core 362, wherein the first magnetic core 361 is a U-shaped magnetic core and the second magnetic core 362 is an I-shaped magnetic core. The second magnetic core 362 can be inserted into the through hole 315, and the first channel 341 and the second channel 351 corresponding to the through hole 315, and the first magnetic core 361 is disposed on the main body 31.

Please refer to both FIG. 3(*a*) and FIG. 3(*b*), wherein FIG. 3(*b*) is a cross-sectional view of FIG. 3(*a*) along A-A' line. As shown in FIG. 3(*b*), the indentations 316 are disposed on both ends of the main body 31. The through hole 315 penetrates through the main body 31 and communicates with the first receiving chamber 313 and the second receiving chamber 314, and the end openings of the through hole 315 lead to the indentations 316. The first channel 341 of the first winding portion 34 and the second channel 351 of the second winding portion 35 also communicate with the through hole 315 when the first winding portion 34 and the second winding portion 35 are respectively disposed in the first receiving chamber 313 and the second receiving chamber 314.

Please refer to both FIG. 3(*a*) and FIG. 3(*c*), wherein FIG. 3(*c*) is a schematic view showing the assembled structure of the transformer in FIG. 3(*a*). When assembling the transformer 3, the first winding portion 34 having the primary winding coil 32 wound thereon and the second winding portion 35 having the secondary winding coil 33 wound thereon are first inserted into the first receiving chamber 313 and the second receiving chamber 314, respectively, and then the second magnetic core 362 is inserted into the through hole 315, the first channel 341 and the second channel 351, and partially disposed in the indentations 316. Subsequently, the first magnetic core 361 is disposed on the main body 31, and the extending portions 363 of the first magnetic core 361 are disposed in the indentations 316 and contact with the second magnetic core 362 for producing an electromagnetic coupling effect between the primary winding coil 32 and the secondary winding coil 33 to modulate the voltage.

Please refer to FIG. 4(*a*), which is an exploded view showing the transformer structure according to the second preferred embodiment of the present invention. As shown in FIG. 4(*a*), the transformer 4 comprises a main body 41, a primary winding coil 42, secondary winding coils 43, 44, a first winding portion 45, a second winding portion 46, a third winding portion 47 and a magnetic core assembly 48. The transformer 4 in this embodiment has one more winding portion than the embodiment shown in FIG. 3(*a*). The additional winding portion, the third winding portion 47, can increase the voltage output from the transformer 4 to drive more electric appliances. For example, the transformer 3 shown in FIG. 3(*a*) can provide the working voltage for only one lamp, but the transformer 4 shown in FIG. 4(*a*) can provide the working voltage for more than two lamps.

The main body 41 has a first side 411, a second side 412, a first receiving chamber 413, a second receiving chamber 414, a third receiving chamber 415, a through hole 416 and an indentation 417, wherein the first receiving chamber 413 is disposed in the main body 41 and has an opening on the first side 411, the second receiving chamber 414 and the third receiving chamber 415 are disposed in the main body 41 and have openings on the second side 412.

The first winding portion 45, which is mainly used for winding the primary winding coil 42 thereon, comprises a first channel 451 and is disposed in the first receiving chamber 413. The second winding portion 46 and the third winding portion 47, which are mainly used for winding the secondary winding coils 43, 44 thereon, comprise a second channel 461 and a third channel 471 and are disposed in the second receiving chamber 414 and the third receiving chamber 415, respectively. The first receiving chamber 413 and the second receiving chamber 414, as well as the first receiving chamber 413 and the third receiving chamber 415, are respectively separated by separating walls 418, and the first side 411 and the second side 412 are on the opposite sides of the main body 41.

Since the first receiving chamber 413 and the second receiving chamber 414, as well as the first receiving chamber 413 and the third receiving chamber 415, respectively have the separating walls 418 disposed therebetween and the openings thereof are disposed on the opposite sides of the main body 41, the creepage distances between the first winding portion 45 and the second winding portion 46 and between the first winding portion 45 and the third winding portion 47 are increased by the separation of the main body 41, so as to improve the safety of the electric appliance and increase the leakage inductance when the first winding portion 45, the second winding portion 46 and the third winding portion 47 are respectively disposed in the first receiving chamber 413, the second receiving chamber 414 and the third receiving chamber 415.

The magnetic core assembly 48 can be a UI-core assembly in this embodiment and comprises a first magnetic core 481 and a second magnetic core 482, wherein the first magnetic core 481 is a U-shaped magnetic core and the second magnetic core 482 is an I-shaped magnetic core. The second magnetic core 482 can be inserted into the through hole 416, the first channel 451, the second channel 461 and the third channel 471 corresponding to the through hole 416, and the first magnetic core 481 is disposed on the main body 41.

Please refer to both FIG. 4(*a*) and FIG. 4(*b*), wherein FIG. 4(*b*) is a cross-sectional view of FIG. 4(*a*) along B-B' line. As shown in FIG. 4(*b*), the indentations 417 are disposed on both ends of the main body 41. The through hole 416 penetrates through the main body 41 and communicates with the first receiving chamber 413, the second receiving chamber 414 and the third receiving chamber 415, and the end openings of the through hole 416 lead to the indentations 417. The first channel 451 of the first winding portion 45, the second channel 461 of the second winding portion 46 and the third channel 471 of the third winding portion 47 also communicate with the through hole 416 when the first winding portion 45, the second winding portion 46 and the third winding portion 47 are respectively disposed in the first receiving chamber 413, the second receiving chamber 414 and the third receiving chamber 415.

Please refer to both FIG. 4(*a*) and FIG. 4(*c*), wherein FIG. 4(*c*) is a schematic view showing the assembled structure of the transformer in FIG. 4(*a*). When assembling the transformer 4, the first winding portion 45 having the primary winding coil 42 wound thereon, and the second winding portion 46 and the third winding portion 47 having the secondary winding coils 43, 44 wound thereon are first inserted into the first receiving chamber 413, the second receiving chamber 414 and the third receiving chamber 415, respectively, and then the second magnetic core 482 is inserted into the through hole 416, the first channel 451, the second channel 461 and the third channel 471, and partially disposed in the indentations 417. Subsequently, the first magnetic core 481 is disposed on the main body 41, and the extending portions 483 of the first magnetic core 481 are disposed in the indentations 417 and contact with the second magnetic core 482 for producing an electromagnetic coupling effect between the primary winding coil 42 and the secondary winding coils 43, 44 to modulate the voltage.

Please refer to FIG. 4(*d*), which is an exploded view showing the transformer structure according to a derivative embodiment from FIG. 4(*a*). As shown in FIG. 4(*d*), the upper surface of the main body 41 further comprises two upward extending boards 419 to form a receiving groove therebetween. Both ends of each extending board 419 are reached to the openings of the indentations 417 for receiving the first magnetic core 481 when assembling the main body 41 and the first magnetic core 481. The extending portions 483 of the first magnetic core 481 are disposed in the indentations 417 and contact with the second magnetic core 482 for producing an electromagnetic coupling effect between the primary winding coil 42 and the secondary winding coils 43, 44 to modulate the voltage.

Please refer to FIG. 5(*a*), which is an exploded view showing the transformer structure according to the third preferred embodiment of the present invention. As shown in FIG. 5(*a*), the transformer 5 comprises a main body 41, a primary winding coil 42, secondary winding coils 43, 44, a first winding portion 45, a second winding portion 46 and a third winding portion 47, wherein the structures, positions and functions of the above have been described in the second preferred embodiment of FIGS. 4(*a*)-(*c*) and are not redundantly described here.

In this embodiment, the magnetic core assembly 51 is a UU-core assembly, that is to say, both the first magnetic core 511 and the second magnetic core 512 are U-shaped magnetic cores, and each comprises two extending portions 513 at the two sides thereof. When assembling the transformer 5, one of the extending portions 513 of each of the first magnetic core 511 and the second magnetic core 512 are inserted into the through hole 416, and the first channel 451, the second channel 461 and the third channel 471 corresponding to the through hole 416. After combining the main body 41 and the magnetic core assembly 51, the extending portions 513 of the first magnetic core 511 contact with the extending portions 513 of the second magnetic core 512 for producing an electromagnetic coupling effect between the primary winding coil 42 and the secondary winding coils 43, 44 to modulate the voltage.

Please refer to both FIG. 5(*a*) and FIG. 5(*b*), wherein FIG. 5(*b*) is a schematic view showing the assembled structure of the transformer in FIG. 5(*a*). When assembling the transformer 5, the first winding portion 45 having the primary winding coil 42 wound thereon, and the second and third winding portions 46, 47 having the secondary winding coils 43, 44 wound thereon are first inserted into the first receiving chamber 413, the second receiving chamber 414 and the third receiving chamber 415, respectively. Then, one of the extending portions 513 of the first magnetic core 511 is inserted into the through hole 416, the second channel 461 and the first channel 451, and the extending portion 513 of the second magnetic core 512 which corresponds to the inserted extending portion 513 of the first magnetic core 511 is sequentially inserted from the other side of the main body 41 into the through hole 416, the third channel 471 and the first channel 451. The inserted extending portions 513 of the first magnetic core 511 and the second magnetic core 512 contact with each other in the first channel 451, and the extending portions 513 at the other sides of the first magnetic core 511 and the second magnetic core 512 are exposed outside the main body 41 and also contact with each other. The assembled structure of the transformer 5 is shown in FIG. 5(*b*).

In this embodiment, the indentations 52 disposed in both ends of the main body 41 can make the magnetic core assembly 51 be partially disposed in the indentations 52 and be supported by the main body 41 steadily when the magnetic core assembly 51 is inserted into the through hole 416 of the main body 41.

Please refer to FIG. 5(*c*), which is an exploded view showing the transformer structure according to a derivative embodiment from FIG. 5(*a*). As shown in FIG. 5(*c*), the transformer 55 mainly comprises a first winding module 551, a second winding module 552 and a magnetic core assembly 56. Each of the first winding module 551 and the second winding module 552 comprises a main body 41, a primary winding coil 42, secondary winding coils 43, 44, a first winding portion 45, a second winding portion 46 and a third winding portion 47. The first winding module 551 includes a first through hole 553 penetrating through the main body 41, and the second winding module 552 includes a second through hole 554 penetrating through the main body 41. Similarly, the structures, positions and functions of the main body 41, the primary winding coil 42, the secondary winding coils 43, 44, the first winding portion 45, the second winding portion 46 and the third winding portion 47 have been described in the second preferred embodiment and are not redundantly described here.

The magnetic core assembly 56 can also be a UU-core assembly, i.e. both the first magnetic core 561 and the second magnetic core 562 are U-shaped magnetic cores. The first magnetic core 561 includes a first extending portion 563 and a second extending portion 564, and the second magnetic core 562 includes a first extending portion 565 and a second extending portion 566.

Please refer to both FIG. 5(*c*) and FIG. 5(*d*), wherein FIG. 5(*d*) is a schematic view showing the assembled structure of the transformer in FIG. 5(*c*). When assembling the transformer 55, the first winding portion 45 having the primary winding coil 42 wound thereon, and the second and third winding portions 46, 47 having the secondary winding coils 43, 44 wound thereon of each of the first winding module 551 and the second winding module 552 are first inserted into the first receiving chamber 413, the second receiving chamber 414 and the third receiving chamber 415, respectively. Then the first extending portion 563 of the first magnetic core 561 is inserted into the first through hole 553 of the first winding module 551, the third channel 471 and the first channel 451, and the first extending portion 565 of the second magnetic core 562 is sequentially inserted from the other side of the main body 41 into the first through hole 553 of the first winding module 551, the second channel 461 and the first channel 451 to make the first extending portion 563 of the first magnetic core 561 contact with the first extending portion 565 of the second magnetic core 562 in the first channel 451. The second extending portion 564 of the first magnetic core 561 is inserted into the second through hole 554 of the second winding module 552, the third channel 471 and the first channel 451, and the second extending portion 566 of the second magnetic core 562 is sequentially inserted from the other side of the main body 41 into the second through hole 554 of the second winding module 552, the second channel 461 and the first channel 451 to make the second extending portion 564 of the first magnetic core 561 contact with the second extending portion 566 of the second magnetic core 562 in the first channel 451. After the first magnetic core 561 and the second magnetic core 562 are inserted into the first through hole 553 and the second through hole 554 and contact with each other, the first winding module 551, the second winding module 552 and the magnetic core assembly 56 are assembled to complete the transformer structure shown in FIG. 5(*d*).

In this embodiment, the transformer 55 uses only one magnetic core assembly to combine the first winding module 551 and the second winding module 552 and can output four sets of voltage, for example. This design not only reduces the cost of manufacturing the transformer but also saves the space when the transformer is installed on a printed circuit board of a power supply system.

Figure 6A:
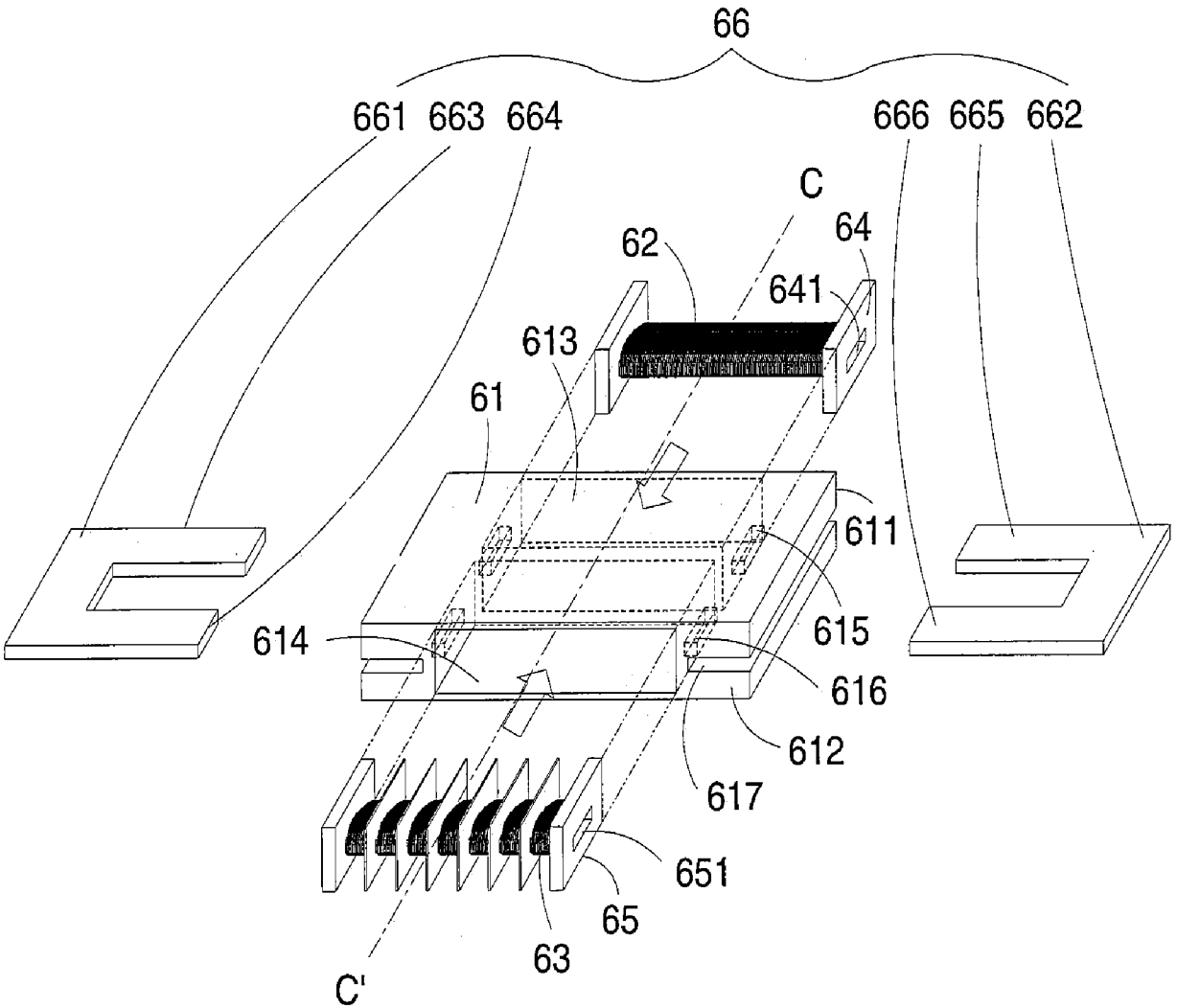
FIG. 6(*a*) is an exploded view showing the transformer structure according to the fourth preferred embodiment of the present invention.
Figure 6B:
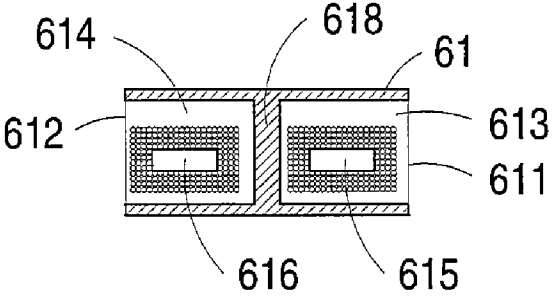
Figure 6C:
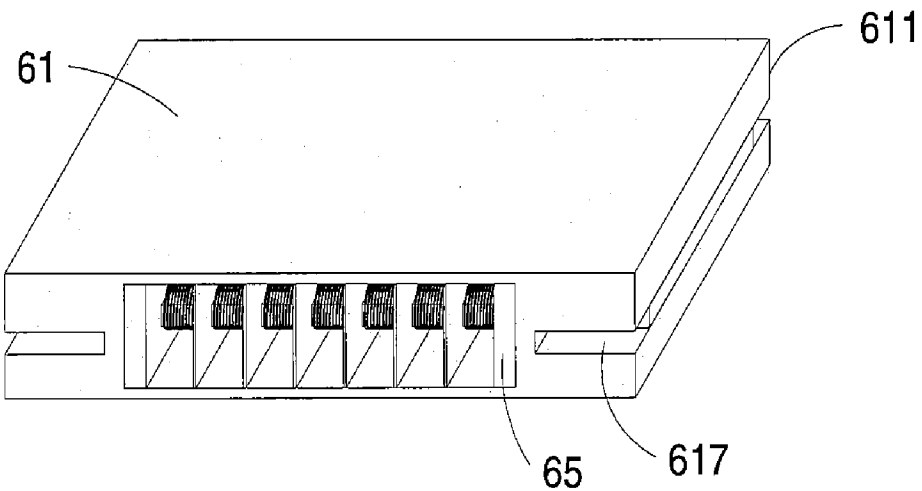

Please refer to FIG. 6(*a*), which is an exploded view showing the transformer structure according to the fourth preferred embodiment of the present invention. As shown in FIG. 6(*a*), the transformer 6 comprises a main body 61, a primary winding coil 62, a secondary winding coil 63, a first winding portion 64, a second winding portion 65 and a magnetic core assembly 66. The main body 61 comprises a first side 611, a second side 612, a first receiving chamber 613, a second receiving chamber 614, a first through hole 615, a second through hole 616 and an indentation 617. The structures, positions and functions of the main body 61, the primary winding coil 62, the secondary winding coil 63, the first winding portion 64 and the second winding portion 65 have been described in the first preferred embodiment and are not redundantly described here.

The first winding portion 64, which is mainly used for winding the primary winding coil 62 thereon, comprises a first channel 641 and is disposed in the first receiving chamber 613 communicating with the first side 611 of the main body 61. The second winding portion 65, which is mainly used for winding the secondary winding coil 63 thereon, comprises a second channel 651 and is disposed in the second receiving chamber 614 communicating with the second side 612 of the main body 61.

In the embodiment, the first through hole 615 communicates with the first receiving chamber 613 and the openings thereof lead to the indentations 617, so the first through hole 615 communicates with the first channel 641 of the first winding portion 64 after the first winding portion 64 is disposed in the first receiving chamber 613. As well, the second through hole 616 communicates with the second receiving chamber 614 and the openings thereof lead to the indentations 617, so the second through hole 616 communicates with the second channel 651 of the second winding portion 65 after the second winding portion 65 is disposed in the second receiving chamber 614.

Please refer to FIG. 6(*b*), which is a cross-sectional view of FIG. 6(*a*) along C-C' line. As shown in FIG. 6(*b*), the first receiving chamber 613 is close to the first side 611 and occupies half space of the main body 61, and the second receiving chamber 614 is close to the second side 612 and occupies the other half space of the main body 61. A separating wall 618 is disposed between the first receiving chamber 613 and the second receiving chamber 614 for separating the first receiving chamber 613 and the second receiving chamber 614 and increasing the distance between the primary winding coil 62 and secondary winding coil 63, so as to reduce the coupling coefficient and increase the leakage inductance.

Besides, the magnetic core assembly 66 is a UU-core assembly, so both the first magnetic core 661 and the second magnetic core 662 are U-shaped magnetic cores (as shown in FIG. 6(*a*)). The first magnetic core 661 includes a first extending portion 663 and a second extending portion 664, and the second magnetic core 662 also includes a first extending portion 665 and a second extending portion 666. The indentations 617 disposed in both ends of the main body 61 can make the magnetic core assembly 66 be partially disposed in the indentations 617 and be supported by the main body 61 steadily when the magnetic core assembly 66 is inserted into the first through hole 615 and the second through hole 616 of the main body 61.

Please refer to both FIG. 6(*a*) and FIG. 6(*c*), wherein FIG. 6(*c*) is a schematic view showing the assembled structure of the transformer in FIG. 6(*a*). When assembling the transformer 6, the first winding portion 64 having the primary winding coil 62 wound thereon and the second winding portion 65 having the secondary winding coil 63 wound thereon are first inserted into the first receiving chamber 613 and the second receiving chamber 614. Then, the first extending portion 663 of the first magnetic core 661 is inserted into the first through hole 615 and the first channel 641, and the first extending portion 665 of the second magnetic core 662 is inserted into the first through hole 615 and the first channel 641 from the other side of the main body 61; similarly, the second extending portion 664 of the first magnetic core 661 is inserted into the second through hole 616 and the second channel 651, and the second extending portion 666 of the second magnetic core 662 is inserted into the second through hole 616 and the second channel 651 from the other side of the main body 61. Accordingly, the first extending portion 663 of the first magnetic core 661 and the first extending portion 665 of the second magnetic core 662 contact with each other in the first channel 641, and the second extending portion 664 of the first magnetic core 661 and the second extending portion 666 of the second magnetic core 662 contact with each other in the second channel 651. The assembled structure of the transformer 6 is shown in FIG. 6(*c*).

Figure 7A:
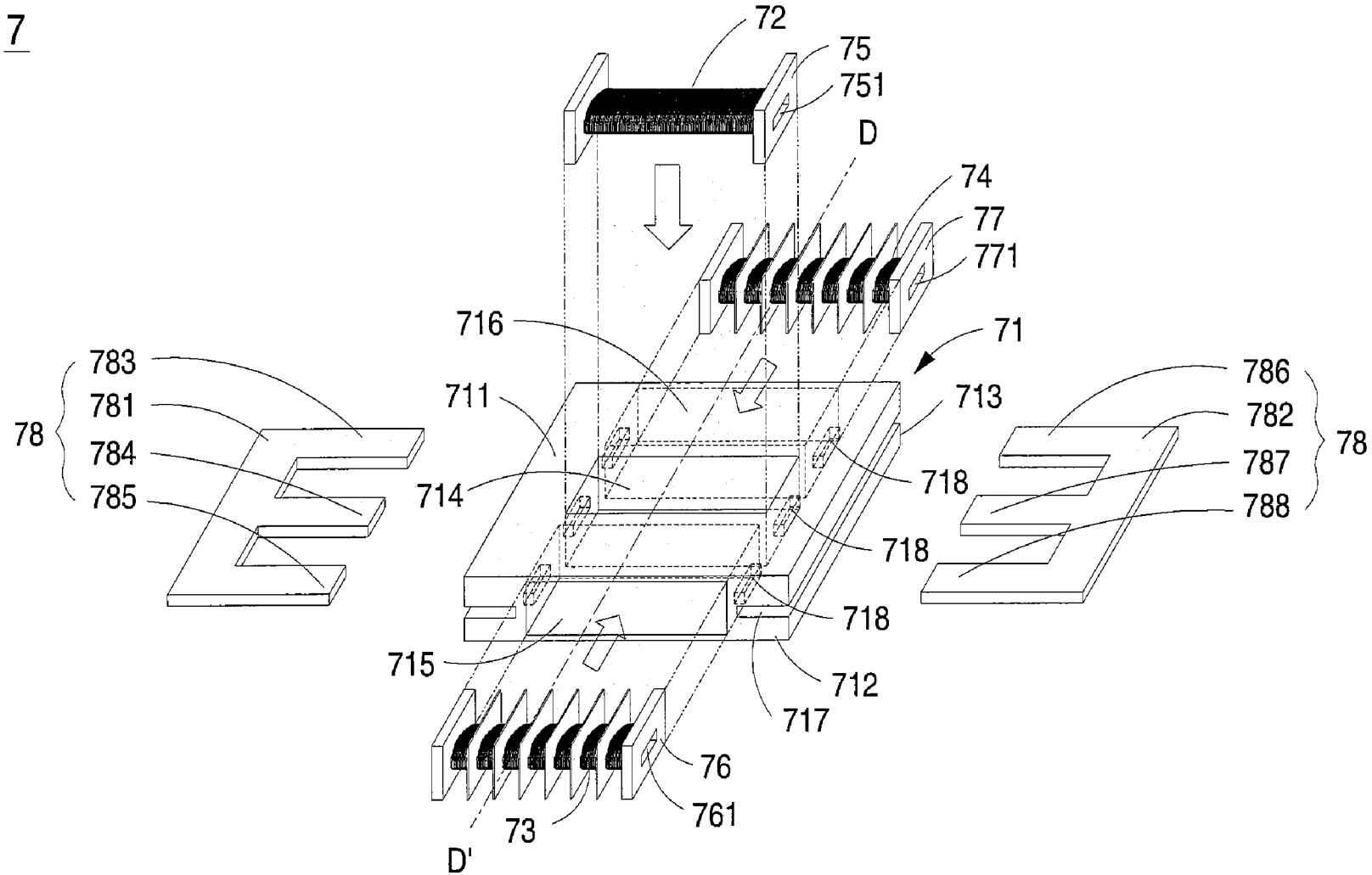
FIG. 7(*a*) is an exploded view showing the transformer structure according to the fifth preferred embodiment of the present invention.
Figure 7B:
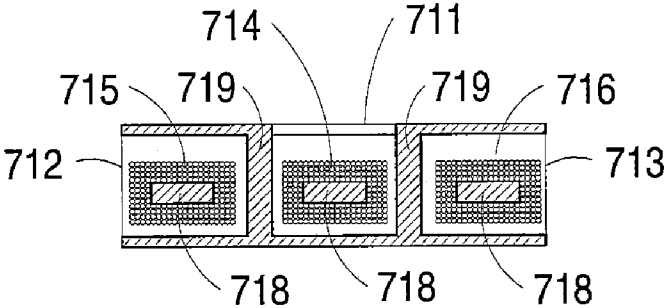
Figure 7C:
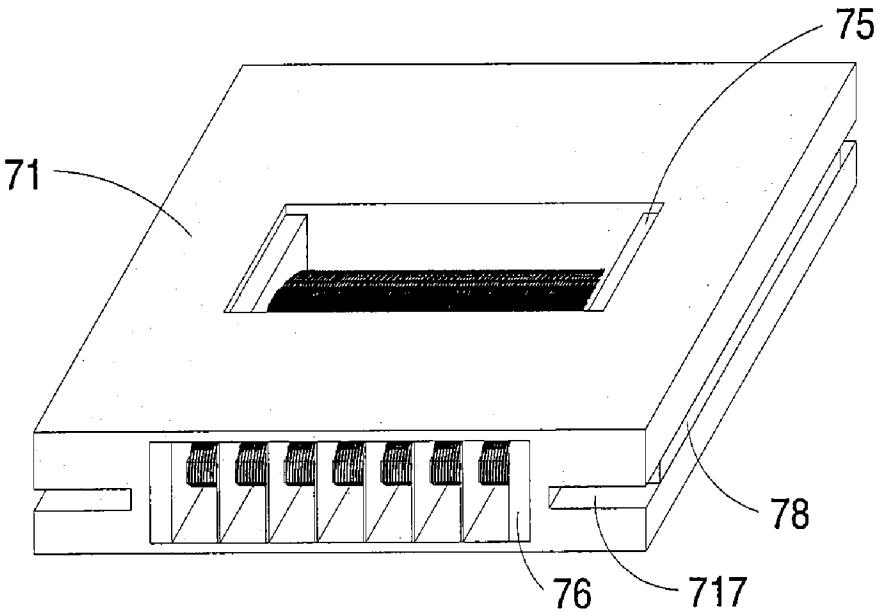

Please refer to FIG. 7(*a*), which is an exploded view showing the transformer structure according to the fifth preferred embodiment of the present invention. As shown in FIG. 7(*a*), the transformer 7 comprises a main body 71, a primary winding coil 72, secondary winding coils 73, 74, a first winding portion 75, a second winding portion 76, a third winding portion 77 and a magnetic core assembly 78. The main body 71 has a first side 711, a second side 712, a third side 713, a first receiving chamber 714, a second receiving chamber 715, a third receiving chamber 716 and an indentation 717. The first receiving chamber 714 is disposed in the main body 71 and has an opening on the first side 711, the second receiving chamber 715 is disposed in the main body 71 and has an opening on the second side 712 and the third receiving chamber 716 is disposed in the main body 71 and has an opening on the third side 713. The structures, positions and functions of the main body 71, the primary winding coil 72, the secondary winding coils 73, 74, the first winding portion 75, the second winding portion 76 and the third winding portion 77 have been described in the second preferred embodiment and are not redundantly described here.

In this embodiment, the first receiving chamber 714, the second receiving chamber 715 and the third receiving chamber 716 for respectively receiving the first winding portion 75, the second winding portion 76 and the third winding portion 77 have openings disposed on different sides of the main body 71 for increasing the distance between the primary winding coil 72 and secondary winding coils 73, 74, so as to reduce the coupling coefficient and increase the leakage inductance. The first channel 751 of the first winding portion 75, the second channel 761 of the second winding portion 76 and the third channel 771 of the third winding portion 77 correspond to the through holes 718 of the main body 71.

Please refer to FIG. 7(*b*), which is a cross-sectional view of FIG. 7(*a*) along D-D' line. As shown in FIG. 7(*b*), the first receiving chamber 714 has the opening disposed on the first side 711 and substantially occupies only one third of space of the main body 71, the second receiving chamber 715 has the opening disposed on the second side 712 and substantially occupies one third of space of the main body 71, and the third receiving chamber 716 has the opening disposed on the third side 713 and substantially occupies one third of space of the main body 71. Besides, separating walls 719 are respectively disposed between the first receiving chamber 714 and the second receiving chamber 715 and between the first receiving chamber 714 and the third receiving chamber 716 for separating the first receiving chamber 714 and the second receiving chamber 715, and the first receiving chamber 714 and the third receiving chamber 716, respectively, and increasing the distance between the primary winding coil 72 and secondary winding coils 73, 74, so as to reduce the coupling coefficient and increase the leakage inductance.

The magnetic core assembly 78 comprises a first magnetic core 781 and a second magnetic core 782. When assembling the transformer 7, the first winding portion 75 having the primary winding coil 72 wound thereon, the second and third winding portions 76, 77 having the secondary winding coils 73, 74 wound thereon are first inserted into the first receiving chamber 714, the second receiving chamber 715 and the third receiving chamber 716, respectively. Then the first extending portion 783 of the first magnetic core 781 is inserted into the through hole 718 and the third channel 771, the first extending portion 786 of the second magnetic core 782 is inserted into the through hole 718 and the third channel 771, the second extending portion 784 of the first magnetic core 781 is inserted into the through hole 718 and the first channel 751, the second extending portion 787 of the second magnetic core 782 is inserted into the through hole 718 and the first channel 751, the third extending portion 785 of the first magnetic core 781 is inserted into the through hole 718 and the second channel 761, and the third extending portion 788 of the second magnetic core 782 is inserted into the through hole 718 and the second channel 761. Accordingly, the extending portions 783, 784 and 785 of the first magnetic core 781 and the extending portions 786, 787 and 788 of the second magnetic core 782 respectively contact with each other in the third, first and second channels 771, 751 and 761. The assembled structure of the transformer 7 is shown in FIG. 7(*c*).

From the above descriptions, since the transformer structure of the present invention disposes the first winding portion and the second winding portion in different receiving chambers, the creepage distance between the primary winding coil and the secondary winding coil can be increased by the separation of the main body, so as to reduce the coupling coefficient, increase the leakage inductance and secure the safety of the electric appliance. Therefore, the present invention possesses high industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer structure comprising:

a main body having a first side, a second side, at least a through hole, a first receiving chamber communicating with said first side, a second receiving chamber communicating with said second side, and a separating wall disposed between said first receiving chamber and said second receiving chamber;

a primary winding coil;

a secondary winding coil;

a first winding portion for winding said primary winding coil thereon, said first winding portion being disposed in said first receiving chamber and having a first channel communicating with said through hole;

a second winding portion for winding said secondary winding coil thereon, said second winding portion being disposed in said second receiving chamber and having a second channel communicating with said through hole; and a magnetic core assembly partially disposed in said through hole of said main body, said first channel of said first winding portion and said second channel of said second winding portion.

2. The transformer structure according to claim 1 wherein said first side and said second side are on opposite sides of said main body.

3. The transformer structure according to claim 1 wherein both ends of said main body respectively comprise an indentation for receiving part of said magnetic core assembly when assembling said main body and said magnetic core assembly.

4. The transformer structure according to claim 3 wherein an opening of said through hole leads to said indentation for receiving said magnetic core assembly.

5. The transformer structure according to claim 4 wherein said magnetic core assembly is a UI-core assembly, a UU-core assembly or an EE-core assembly and comprises a first magnetic core and a second magnetic core.

6. The transformer structure according to claim 5 wherein said magnetic core assembly is said UI-core assembly, said first magnetic core is a U-shaped magnetic core and has a plurality of extending portions, said second magnetic core is an I-shaped magnetic core and is received in said through hole and said indentation, said first magnetic core is disposed on said main body, and said plurality of extending portions are received in said indentation for contacting with said second magnetic core.

7. The transformer structure according to claim 5 wherein said magnetic core assembly is said UU-core assembly, each of said first magnetic core and said second magnetic core is a U-shaped magnetic core and has a plurality of extending portions, one of said extending portions of each of said first magnetic core and said second magnetic core is disposed in said through hole and said indentation to make said extending portion of said first magnetic core disposed in said through hole contact with said extending portion of said second magnetic core disposed in said through hole.

8. The transformer structure according to claim 5 wherein said magnetic core assembly is said EE-core assembly, each of said first magnetic core portion and said second magnetic core is an E-shaped magnetic core and has a plurality of extending portions, said extending portions of each of said first magnetic core and said second magnetic core are disposed in corresponding said through holes and said indentation to make said extending portions of said first magnetic core contact with said extending portions of said second magnetic core.

9. The transformer structure according to claim 5 wherein said main body further comprises an extending board to form a receiving groove for receiving said magnetic core assembly.

* * * * *